US009972457B2

(12) United States Patent
Kitahara

(10) Patent No.: US 9,972,457 B2
(45) Date of Patent: May 15, 2018

(54) PUSH SWITCH

(71) Applicant: TOKYO PARTS INDUSTRIAL CO., LTD., Gunma-ken (JP)

(72) Inventor: Takahisa Kitahara, Gunma-ken (JP)

(73) Assignee: Tokyo Parts Industrial Co., Ltd. (JP)

( * ) Notice: Subject to any disclaimer, the term of this patent is extended or adjusted under 35 U.S.C. 154(b) by 0 days. days.

(21) Appl. No.: 15/386,458

(22) Filed: Dec. 21, 2016

(65) Prior Publication Data

US 2017/0213660 A1 Jul. 27, 2017

(30) Foreign Application Priority Data

Jan. 26, 2016 (JP) ..... 2016-012065

(51) Int. Cl.

| | |
|---|---|
| ***H01H 13/14*** | (2006.01) |
| ***H01H 9/04*** | (2006.01) |
| ***H01H 13/52*** | (2006.01) |
| ***H01H 13/06*** | (2006.01) |
| *H01H 9/06* | (2006.01) |

(52) U.S. Cl.

CPC ..... *H01H 9/04* (2013.01); *H01H 13/06* (2013.01); *H01H 13/14* (2013.01); *H01H 13/52* (2013.01); *H01H 9/06* (2013.01); *H01H 2013/066* (2013.01); *H01H 2221/052* (2013.01); *H01H 2221/056* (2013.01); *H01H 2231/026* (2013.01)

(58) Field of Classification Search

CPC .... H01H 9/04; H01H 13/52; H01H 2231/026; H01H 13/14; H01H 13/06; H01H 2221/056; H01H 2221/052; H01H 2013/066; H01H 9/06

USPC ..... 200/520, 341, 302.2, 333

See application file for complete search history.

(56) References Cited

U.S. PATENT DOCUMENTS

| | | | | |
|---|---|---|---|---|
| 8,513,556 | B2 | 8/2013 | Kitahara et al. | |
| 8,575,506 | B2 * | 11/2013 | Kitahara ..... | H01H 13/06 200/302.2 |
| 2012/0024681 | A1 | 2/2012 | Kitahara et al. | |
| 2013/0048482 | A1 * | 2/2013 | Saitou ..... | H01H 13/06 200/341 |

FOREIGN PATENT DOCUMENTS

| | | |
|---|---|---|
| JP | 2006/100013 | 4/2006 |
| JP | 2009/104804 | 5/2009 |
| JP | 2012/244825 | 10/2010 |

* cited by examiner

*Primary Examiner* — Edwin A. Leon
*Assistant Examiner* — Lheiren Mae A Caroc
(74) *Attorney, Agent, or Firm* — Jordan and Koda, PLLC

(57) ABSTRACT

Guide grooves are formed in a peripheral sidewall of a soft button, and a hard cap is separably connected to the button by fitting legs on the cap into these guide grooves. Furthermore, when a push-operation member on the cap is pushed, the legs are guided in the guide grooves, while the press stroke of the push-operation member is regulated by the bottom ends of the legs coming into contact with the top face of an inner flange on the case.

6 Claims, 13 Drawing Sheets

(a)

(b)

(a)

(b)

PUSH SWITCH

BACKGROUND OF THE INVENTION

The present invention relates to a push switch provided, for example, in a vehicle or the like.

Japanese Patent Laid-Open Publication No. 2006-100013 describes a vehicle switch comprising a switch main body, which is held in an external member on the vehicle, and a button, which is provided in an opening in the external member, and is linked to the switch main body. In this vehicle switch, the button comprises a base made from a rubber material, which is provided in the opening in the external member, and linked to the switch main body, and a hard, decorative member, which covers the outside of the base.

With the vehicle switch described in Japanese Patent Laid-Open Publication No. 2006-100013, the decorative member constitutes a part of the exterior design of the external member on the vehicle, and various types of decoration can be provided on the decorative member, allowing for more freedom in the decoration of the button and better design characteristics for the button.

Japanese Patent Laid-Open Publication No. 2009-104804 describes a mounting structure for a pushbutton switch comprising: a switch mounting device provided with a switch exposure opening; and a pushbutton switch, in which a switch main body, which is covered and sealed by an elastic seal material, is operated by a pushbutton part that is exposed via the switch exposure opening when fastened in the switch mounting device. In this mounting structure, the pushbutton part is formed as a cap member, which is formed from a hard material, and is connected to the elastic seal material in an easily detachable manner, detachment of the cap member being regulated by way of a stopper part on this cap member being constrained by the back of the circumferential edge of the switch exposure opening in the switch mounting device.

With the pushbutton switch mounting structure described in Japanese Patent Laid-Open Publication No. 2009-104804, it is possible to flexibly support a variety of color specifications and the like, because the pushbutton part can be easily detached. Furthermore, the pushbutton part will not detach when the switch mounting device is mounted.

Japanese Patent Laid-Open Publication No. 2010-244825 describes a push switch comprising: a soft cylindrical inner button having an outer flange; a hard button fastened to the inner button so as to cover the inner button; a switch board mounted in an opening in the inner button; a switch arranged within the inner button; and a case fastened to the side wall of the inner button. In this push switch, the button has a peripheral sidewall and a top operation wall, an overhanging part being provided at the end of the peripheral sidewall. Furthermore, the overhanging part is arranged so as to face an inner flange provided on the case, and so as to leave a gap between this and the outer flange on the inner button, so that when the switch is turned on by pushing the button and elastically deforming the inner button, the overhanging part comes into contact with the outer flange.

With the push switch described in Japanese Patent Laid-Open Publication No. 2010-244825, because the hard button is arranged so as to cover the soft inner button, the inner button can be protected, even if it is struck by fingernails or the like. Furthermore, the switch is not subjected to excessive pushing forces because, when the switch is turned on, the overhanging part on the button makes contact with the outer flange on the inner button, so that the pushing force on the button is received by the inner flange on the case.

However, with the vehicle switch described in Japanese Patent Laid-Open Publication No. 2006-100013, because the base and the decorative member are connected by fitting a projection provided on the decorative member in a hole provided in the base, which is made from the rubber material, the seal characteristics are readily degraded and there is a risk of water penetrating into the space in which the switch main body is disposed. Furthermore, with the vehicle switch described in Japanese Patent Laid-Open Publication No. 2006-100013, if a large pushing force acts on the button, the thin flexible portion provided in the base, which is made from the rubber material, is unduly stretched, such that there is a risk of the base itself being damaged.

With the pushbutton switch mounting structure described in Japanese Patent Laid-Open Publication No. 2009-104804, the seal characteristics are good because the switch main body is covered and sealed by the elastic seal material. However, because the structure is such that when the pushbutton part is push-operated, a portion of the soft pushbutton part is trapped between the pushbutton part that is made from the hard material and the switch case that is made from the hard material, there is a risk that the portion that is trapped between the pushbutton part and the switch case will be damaged by repeated push-operations and that the seal produced by the elastic seal member will be broken.

With the push switch described in Japanese Patent Laid-Open Publication No. 2010-244825, because the structure is such that, when the button is push-operated, the outer flange on the soft inner button is trapped between the overhanging part on the button, which is made from the hard material, and the inner flange on the case, there is a risk that the outer flange will be damaged by the repeated push-operations and that the seal produced by the inner button will be broken.

SUMMARY OF THE INVENTION

One or more embodiments of the present invention makes use of the advantages of the prior art to provide a highly durable and reliable push switch, in which loss of the seal properties and the durability of the soft button is prevented. Note that, in the aspects described below, the constituent elements employed can be used in the most freely chosen combinations possible. Furthermore, the aspects and technical features of the present invention are not limited to those described hereafter, and are to be understood based on the description in the entire specification and the drawings, or based on the inventive ideas that can be grasped by the skilled artisan on the basis of these descriptions.

A first mode of the present invention, relating to a push switch, comprises:

a soft button having a peripheral sidewall and a roof wall, and having an opening at the bottom;

a hard cap, which is mounted on top of the button;

a base, which is mounted in the opening;

a switch component, which is arranged on the base and in the button; and a case fastened to the outer peripheral face of the peripheral sidewall, wherein the button has a plurality of guide grooves, extending in the vertical direction or the horizontal direction, in the outer face of the peripheral sidewall;

the cap has a top wall, which makes contact with the roof wall, a push-operation member, which protrudes upward from the top wall, and a plurality of legs that extend downward from the top wall, the legs being fitted into the guide grooves, so as to be separably connected to the button; and the press stroke of the push-operation member is regulated by the legs coming into contact with the case when the push-operation member is pushed.

In a second aspect of the present invention, the case has an inner flange, and the legs make contact with the top face of the inner flange, when the push-operation member is pushed.

In a third aspect of the present invention, the guide grooves extend below the contact face of the case, with which the legs make contact when the push-operation member is pushed.

In a fourth aspect of the present invention, the case has an inner flange, the legs making contact with the top face of the inner flange when the push-operation member is pushed; and the guide grooves extend below the top face of the inner flange.

In a fifth aspect of the present invention, the legs have protrusions that protrude to the exterior of the guide grooves; and the protrusions make contact with the case when the push-operation member is pushed.

In a sixth aspect of the present invention, the legs have protrusions that protrude to the exterior of the guide grooves; and the case has an inner flange, the protrusions making contact with the top face of the inner flange, when the push-operation member is pushed.

In a seventh aspect of the present invention, the legs have protrusions that protrude to the exterior of the guide grooves;

the case has an inner flange, the protrusions making contact with the top face of the inner flange, when the push-operation member is pushed; and the guide grooves extend below the top face of the inner flange.

In an eighth aspect of the present invention, the legs are engaged in the guide grooves with the pushing of the push-operation member released.

According to one mode of embodiment of the push switch of the present invention, the cap can be detached from the button, such that a variety of color specifications can be flexibly supported, in addition to which, loss of the seal properties and the durability of the soft button is prevented, such that the durability and reliability of the push switch can be improved.

DETAILED DESCRIPTION OF THE PREFERRED EMBODIMENTS

Hereafter, exemplary modes of embodiment of the present invention are described with reference to the drawings.

Figure 1:
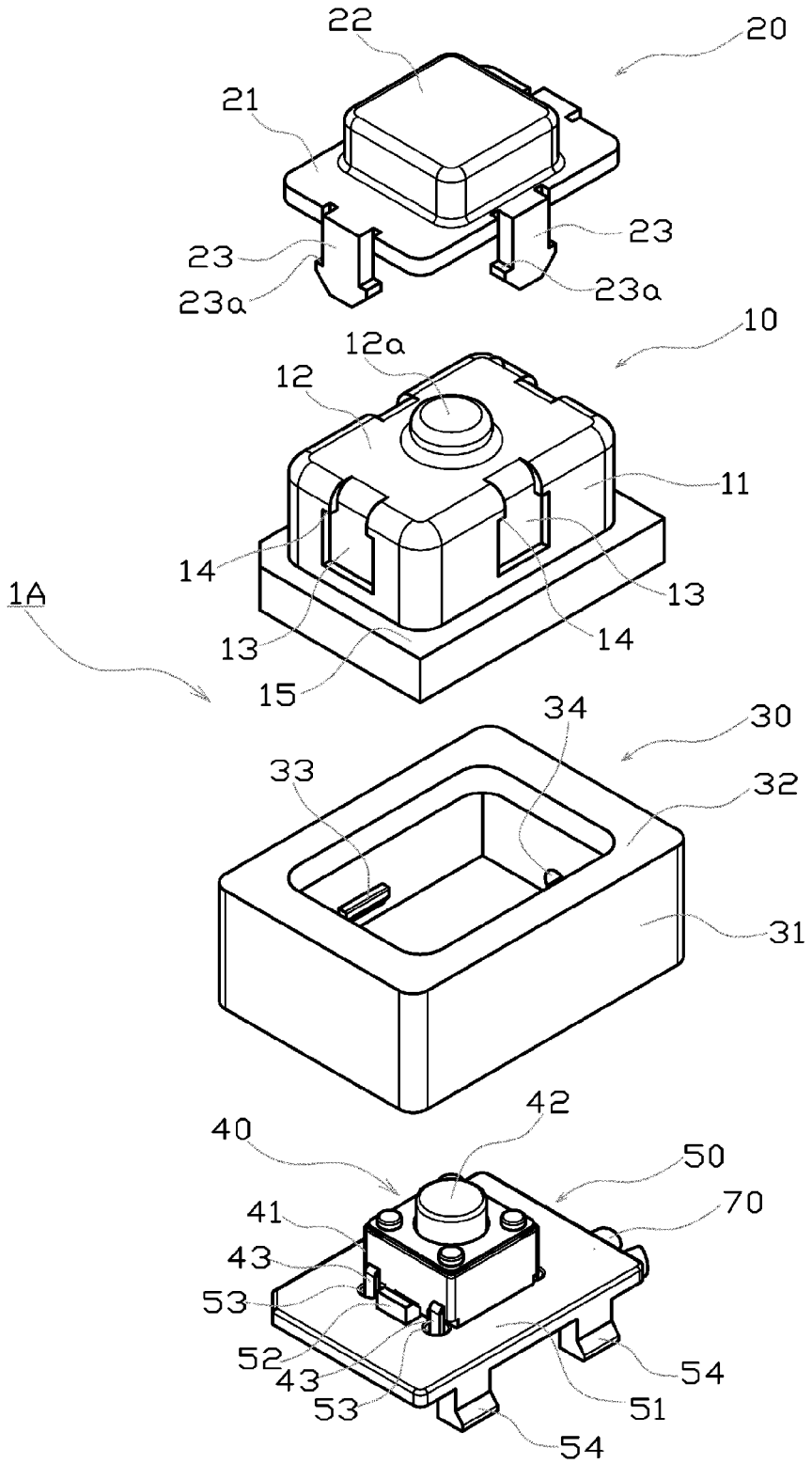
FIG. 1 is an exploded perspective view of a push switch according to a first exemplary mode of embodiment of the present invention.
Figure 2:
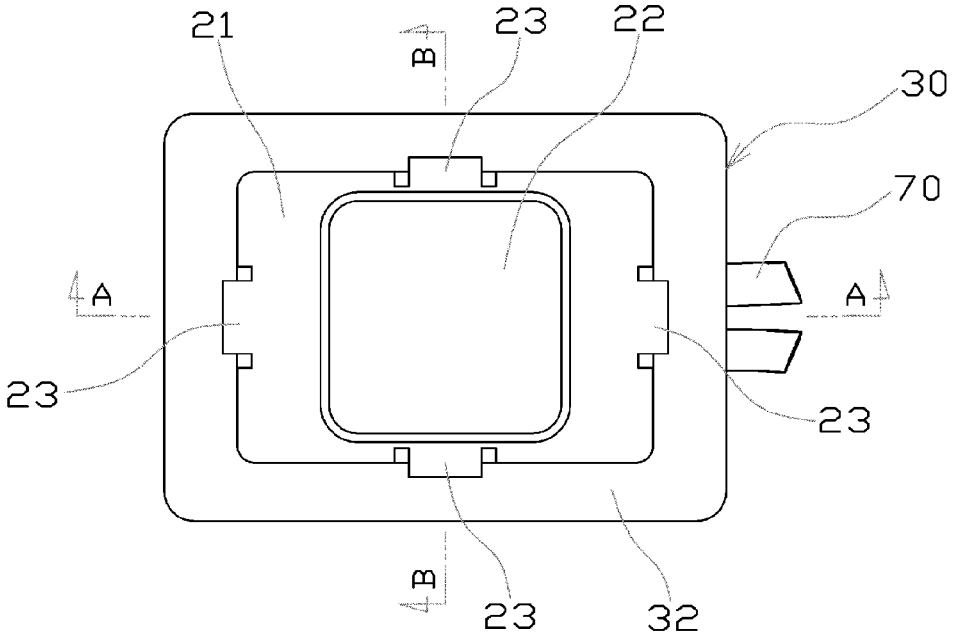
FIG. 2 is a top view of a push switch according to the first exemplary mode of embodiment of the present invention.
Figure 3:
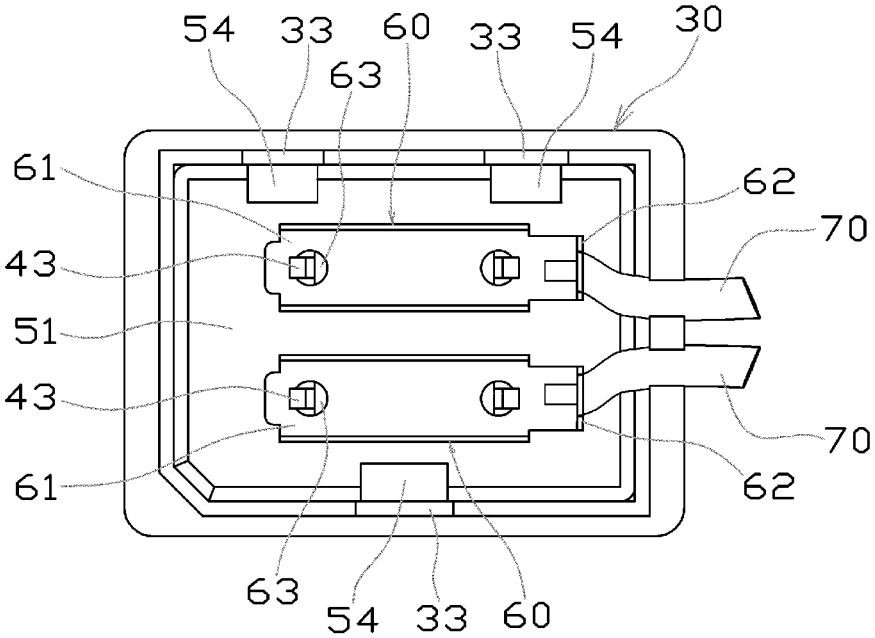
FIG. 3 is a bottom view of the push switch according to the first exemplary mode of embodiment of the present invention.
Figure 4:
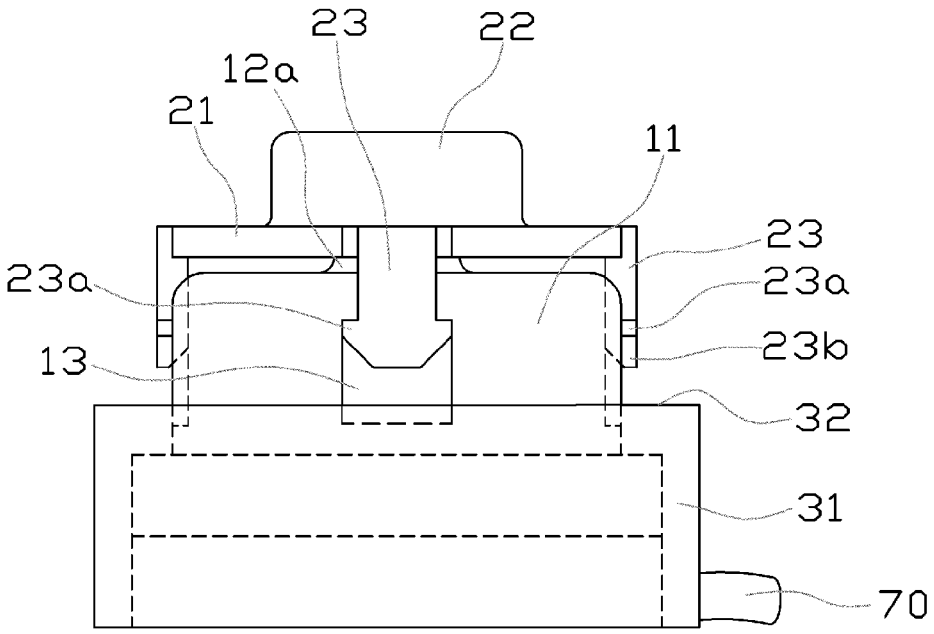
FIG. 4 is a front view of the push switch according to the first exemplary mode of embodiment of the present invention.
Figure 5:
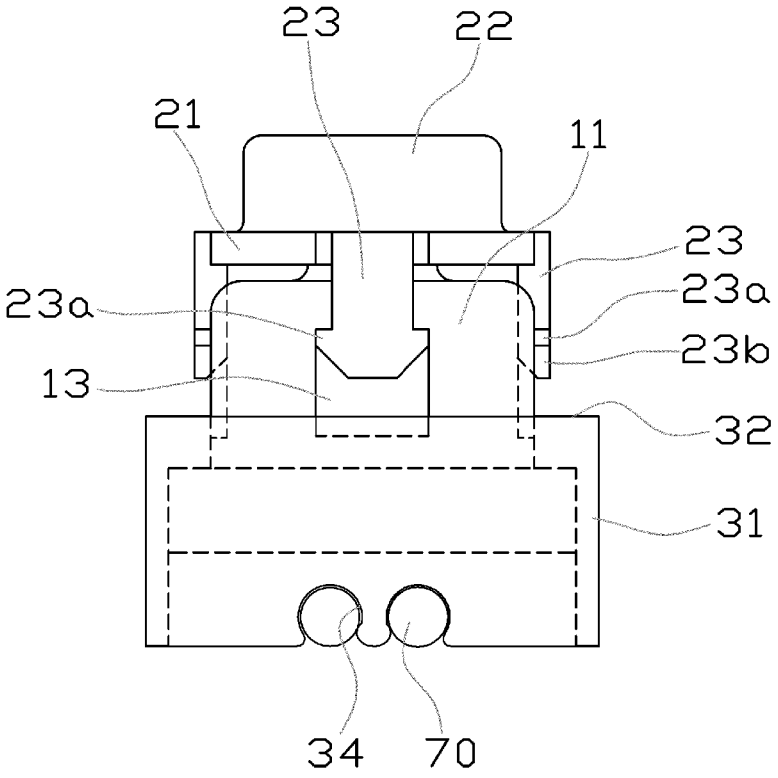
FIG. 5 is a right side-view of the push switch according to the first exemplary mode of embodiment of the present invention.

Note that, in the present specification, the upward direction in FIG. 1 is referred to as "upward" or the like, and the downward direction in FIG. 1 is referred to as "downward" or the like. Furthermore, the upward and downward directions do not indicate positional relationships or directions when the push switch of the present invention is assembled in a vehicle or the like.

First Exemplary Mode of Embodiment

A push switch 1A according to a first exemplary mode of embodiment of the present invention will be described using FIG. 1 to FIG. 7.

Figure 6:
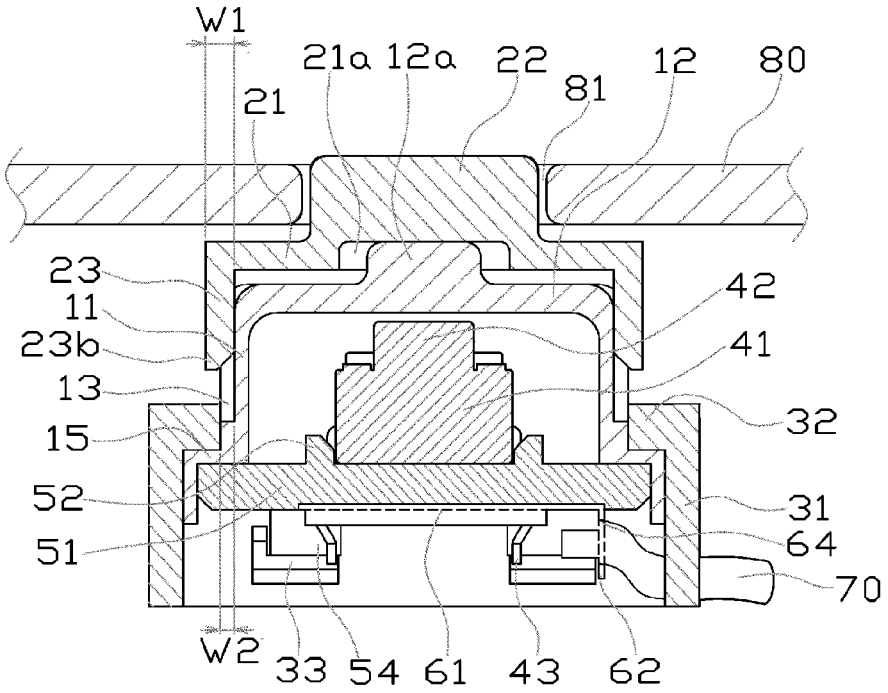
FIG. 6 is a sectional view serving to describe the situation when the push switch according to the first exemplary mode of embodiment of the present invention is not push-operated, in which (a) corresponds to a sectional view at the line A-A in FIG. 2, and (b) corresponds to a sectional view at the line B-B in FIG. 2.
Figure 6:
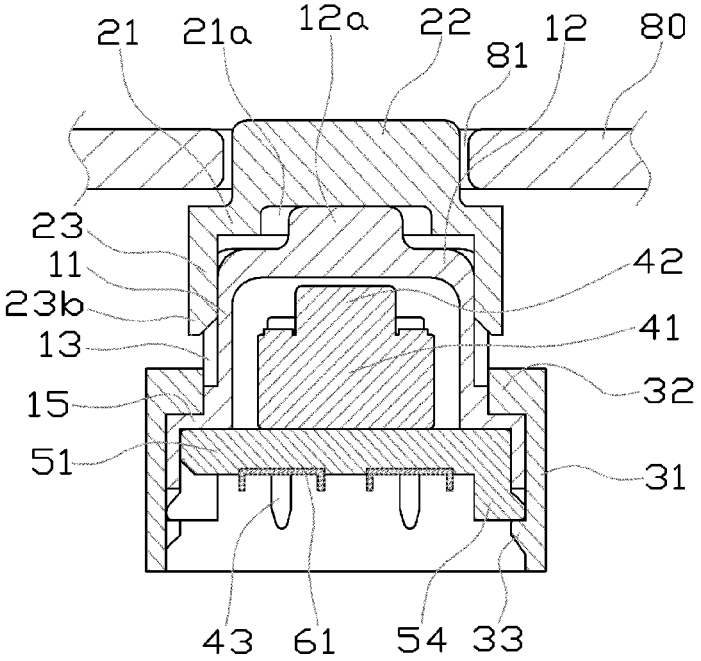
Figure 7:
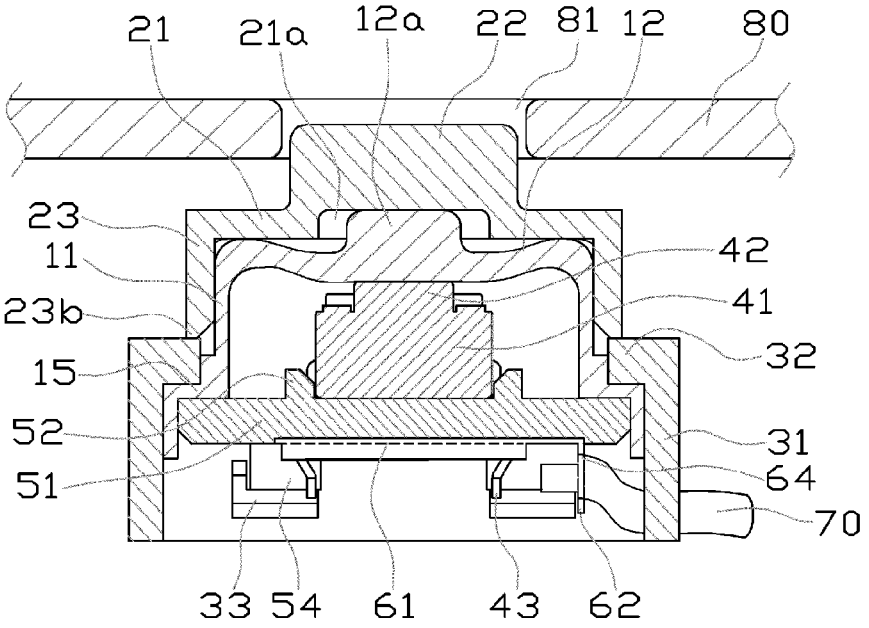
FIG. 7 is a sectional view serving to describe the situation when the push switch according to the first exemplary mode of embodiment of the present invention is push-operated, in which (a) corresponds to a sectional view at the line A-A in FIG. 2, and (b) corresponds to a sectional view at the line B-B.
Figure 7:
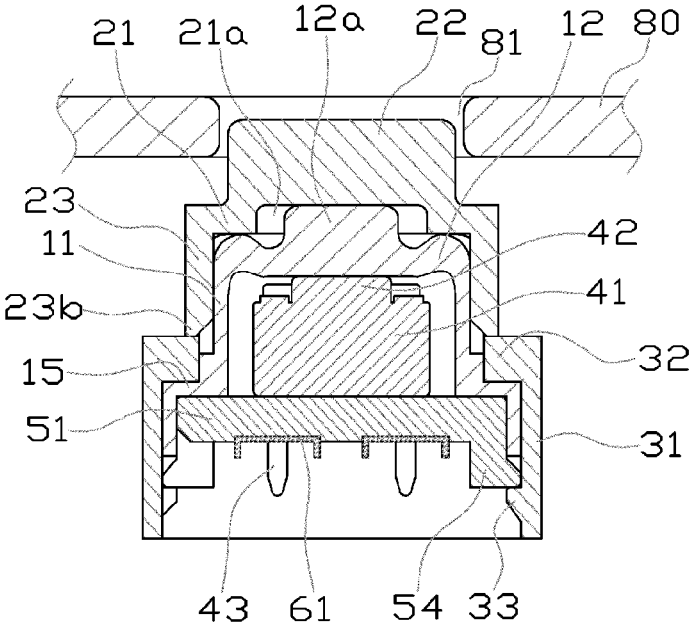

The push switch 1A in this example is mounted in a switch mounting device, which is provided with a switch exposure opening. Specifically, as shown in FIG. 6 and FIG. 7, in the case where the switch mounting device is a vehicle door handle device, when the user operates a door lock device, a push-operation member 22, which is exposed via an opening 81 in a surface member 80 of the vehicle door handle device, is pressed so as to operate the switch, such that the door can be locked or unlocked.

The push switch 1A in this example comprises a button 10, a cap 20, a case 30, a switch 40, a base 50, a terminal member 60, and lead wires 70.

The button 10 is integrally formed from a soft elastic resin such as rubber, and comprises a rectangular plate-like roof wall 12 and a peripheral sidewall 11 that descends from the circumferential edge thereof. There is an opening at the bottom of the button 10.

A substantially cylindrical operation projection 12*a* is provided protruding upward in the center of the top face of the roof wall 12.

Recessed guide grooves 13 are provided extending downward for a predetermined length from the upper edges of the four peripheral faces of the peripheral sidewall 11. The lower portions of the guide grooves 13 are formed with slightly expanded widths, and the top edges of the expanded width portions constitute engaging parts 14, for engaging engaged parts 23*a*, which are provided on legs 23 of the cap 20, described hereafter.

A stepped part 15, which expands outward, is provided in the portion below the guide grooves 13 in the peripheral sidewall 11, all the way therearound.

The case 30 is integrally formed from a hard resin, and comprises a rectangular-cylinder shaped peripheral wall part 31, and an inner flange 32, which extends inward from the top edge of the peripheral wall part 31, all the way therearound.

Engaging claws 33, which protrude inward, are provided on two facing faces of the peripheral wall part 31, and a lead out hole 34 is provided in another face, for leading out the lead wires 70.

The button 10 is mounted in the case 30 so that the top face of the stepped part 15 makes contact with the bottom face of the inner flange 32. Consequently, the top part of the peripheral sidewall 11, the roof wall 12, and the operation projection 12*a* protrude upward from the case 10. Note that the bottom ends of the guide grooves 13 are located slightly below the top face of the inner flange 32.

The switch 40 comprises a rectangular main body 41, a cylindrical operation part 42, and four terminals 43, which extend downward from the main body 41.

The operation part 42 protrudes upward from the main body 41, and is configured so as to be able to move in the vertical direction, biased upward by a non-illustrated elastic member within the main body 41. Note that, when the operation part 42 is pushed downward, the switch is turned on.

This switch 40 is mounted on a base 50, and the switch 40 and the base 50 are housed within the case 30.

The base 50 is integrally formed from a hard resin, and comprises: a rectangular plate-like mounting part 51, on which the switch 40 is mounted; projections 52, which protrude upward from the mounting part 51, and abut two facing side faces of the main body 41; and engaging projections 54, which are formed on the bottom face of the mounting part 51. Insertion holes 53, into which the terminals 43 are inserted, are provided in the mounting part 51.

The engaging projections 54 are provided at three positions corresponding to the engaging claws 33 in the case 30, each of which engaging with an engaging claw 32. Thus, the base 50 is fastened inside the case 30 by way of being mounted so that the periphery of the mounting part 51 fits into the stepped part 15 in the button 10, and closes the opening in the button 10.

Two conductive terminal members 60 are fastened on the bottom face of the mounting part 51.

These terminal members 60 comprise a flat part 61, in which insertion holes 63 are provided, and a descending part 62, which descends from one end of the flat part 61 and in which an insertion hole 64 is provided.

The terminals 43 lead downward through the insertion holes 63, and are electrically connected to the terminal members 60 with solder or the like.

Furthermore, the two lead wires 70 are electrically connected to the terminal members 60, in a state in which one end thereof passes through the insertion hole 64, so as to be supported by the descending part 62, and the other end is led out to the exterior of the case 30, via the lead out hole 34.

Note that the space within the case at the bottom face of the base 50 is uniformly filled with a filler such as an epoxy resin, in which two liquids have been mixed, in order to reliably prevent the ingress of water into the button 10 in which the switch 40 is arranged.

The cap 20 is integrally formed from a hard resin and comprises: a rectangular plate-like top wall 21 having a recess 21*a* in the bottom face; a prismatic push-operation member 22, which protrudes upward from the center of the top face of the top wall 21; and legs 23, which extend downward from the four sides of the top wall 21, and are formed so as to be slightly elastic. Furthermore, engaged parts 23*a* are provided, which are formed so that the widths thereof expand slightly, at a midpoint along the legs 23.

When the cap 20 is mounted on top of the button 10, the operation protrusion 12*a* on the roof wall 12 is partially inserted into the recess 21*a* in the top wall 21, a portion of the roof wall 12 (the top face of the operation projection 12*a*) makes contact with the bottom face of the top wall 21, and the legs 23 fit into the guide grooves 13, the engaged parts 23*a* being engaged by the engaging parts 14. Note that the thickness W1 of the legs 23 is formed so as to be greater than the depth W2 of the guide grooves 13, such that the outsides of the legs 23 constitute protrusions 23*b*, which protrude to the exterior of the guide grooves 13 (see FIG. 6).

The cap 20 that is mounted on top of button 10 is separably connected to the button 10. Specifically, by pulling the cap 20 upward with greater than a predetermined force, the legs 23 are spread outward, and the engagement of the engaged parts 23*a* and the engaging parts 14 is released, such that the cap 20 can be removed from the button 10.

The push switch 1A of this example, which is configured as described above, is fastened in the vehicle door handle device so that the push-operation member 22 is exposed via the opening 81 in the surface member 80 of the vehicle door handle device. When the push switch 1A is arranged in the vehicle door handle device in this manner, the top face of the top wall 21 faces the bottom face of the surface member 80 located at the periphery of the opening 81, with a slight gap therebetween. Consequently, even if the cap 20 is pulled from outside the vehicle door handle device, the top wall 21 will strike the back face of the periphery the opening 81, and therefore it will not be possible to pull out the cap 20.

Furthermore, when the push-operation member 22 is pushed downward from above, in the sense shown in the drawing in FIG. 6, the cap 20 pushes down the operation projection 12*a*, the legs 23 being guided by the guide grooves 13. Consequently, as shown in FIG. 7, the roof wall 12 elastically deforms, the operation part 42 is pushed downward, the switch 40 is turned on, a signal is transmitted to the exterior via the lead wires 70, and the door can be locked or unlocked.

With the push switch 1A of this example as described above, a plurality of guide grooves 13 are formed, which extend in the vertical direction in the outer face of the peripheral sidewall 11 of the soft button 10, and a plurality of legs 23, which extend downward from the top wall 21 of the hard cap 20 fit into these guide grooves 13, whereby the cap 20 is separably connected to the button 10.

Consequently, it is possible to detach the cap 20 from the button 10 and, for example, flexibly support vehicle color specifications and the like by using caps 20 with different color specifications and the like.

Furthermore, with the push switch 1A of this example, when the push-operation member 22 that protrudes upward from the top wall 21 of the cap 20 is pushed, the press stroke of the push-operation member 22 is regulated by the legs 23 coming directly into contact with the case 30.

Specifically, the distance between the bottom ends of the protrusions 23*b* that protrude from the outer face of the peripheral sidewall 11 and the top face of the inner flange 32 is established so as to be substantially the same as the distance of the stroke up to the point at which the switch 40 is turned on by pushing the push-operation member 22.

Consequently, the bottom ends of the protrusions 23*b* make contact with the top face of the inner flange 32 at substantially the same time as the switch 40 is turned on by pushing the push-operation member 22, such that the switch 40 can be reliably protected without unduly large loads being applied to the switch 40. In addition, the soft button 10 is not trapped between the hard cap 20 and the hard case 30 when the press stroke of the push-operation member 22 is regulated, and therefore it is possible to effectively prevent loss of durability in the button 10 as a result of repeated push-operations, such that the seal function provided by the button 10 can be ensured over a long period of time.

Furthermore, in the push switch 1A of this example, the guide grooves 13, which are provided in the button 10, extend below the top face of the inner flange 32. Which is to say, the guide grooves 13 extend below the contact face of the case 30, at which the bottom ends of the legs 23 make contact when the push-operation member 22 is pushed. Consequently, the soft button 10 will not be trapped between the hard cap 20 and the hard case 30 when the press stroke of the push-operation member 22 is regulated, even if the dimensional tolerance in the individual components or assembly tolerance is somewhat large.

Furthermore, in the push switch 1A of this example, the structure is such that the engaged parts 23*a* of the legs 23 are engaged in the engaging parts 14 of the guide grooves 13 when the pushing on the push-operation member 22 is released (the situation in FIG. 6). Consequently, it is possible to prevent looseness in the cap 20 and improve operability.

Second Exemplary Mode of Embodiment

A push switch 1B according to a second exemplary mode of embodiment of the present invention will be described using FIG. 8 to FIG. 10.

Figure 8:
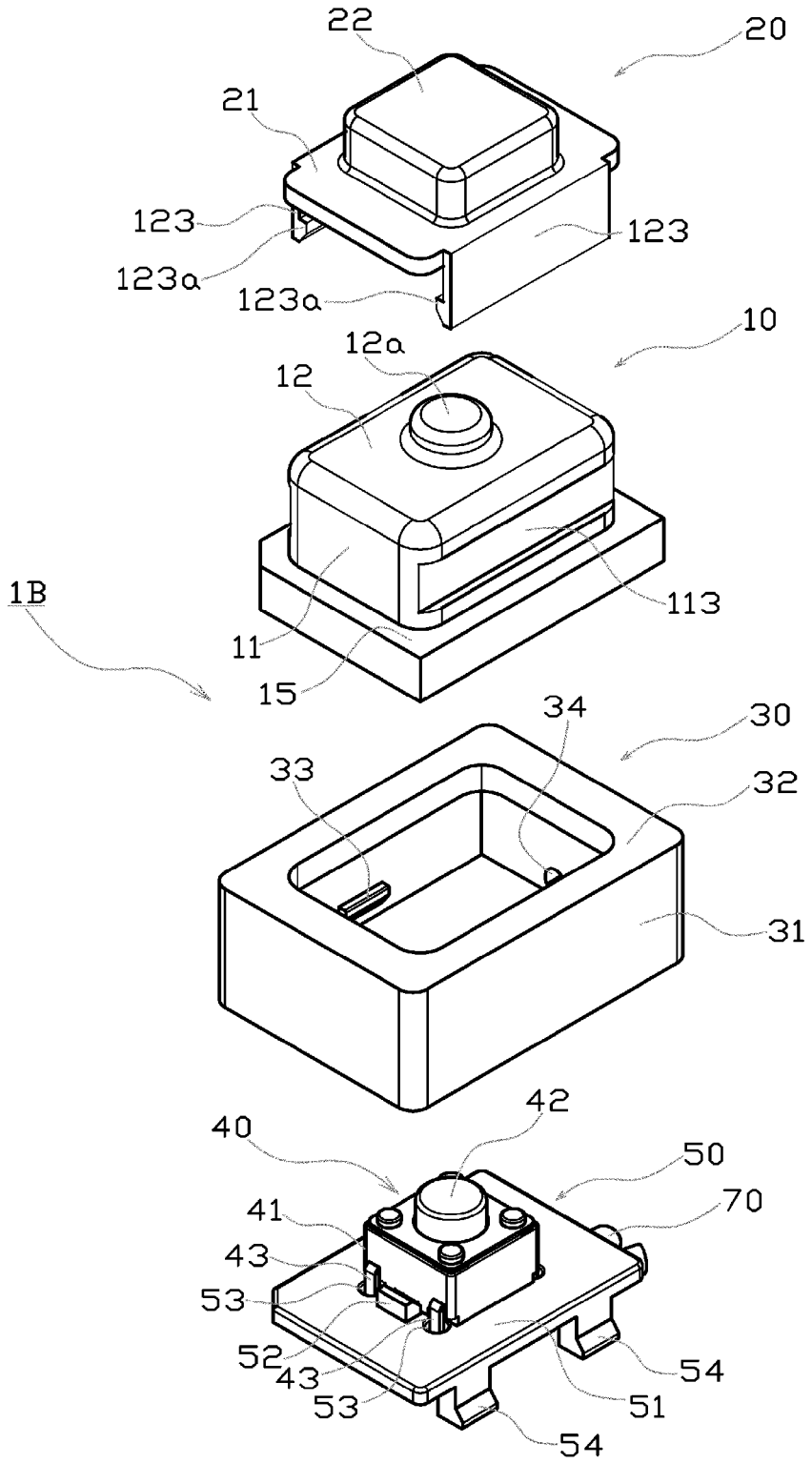
FIG. 8 is an exploded perspective view of a push switch according to a second exemplary mode of embodiment of the present invention.
Figure 9:
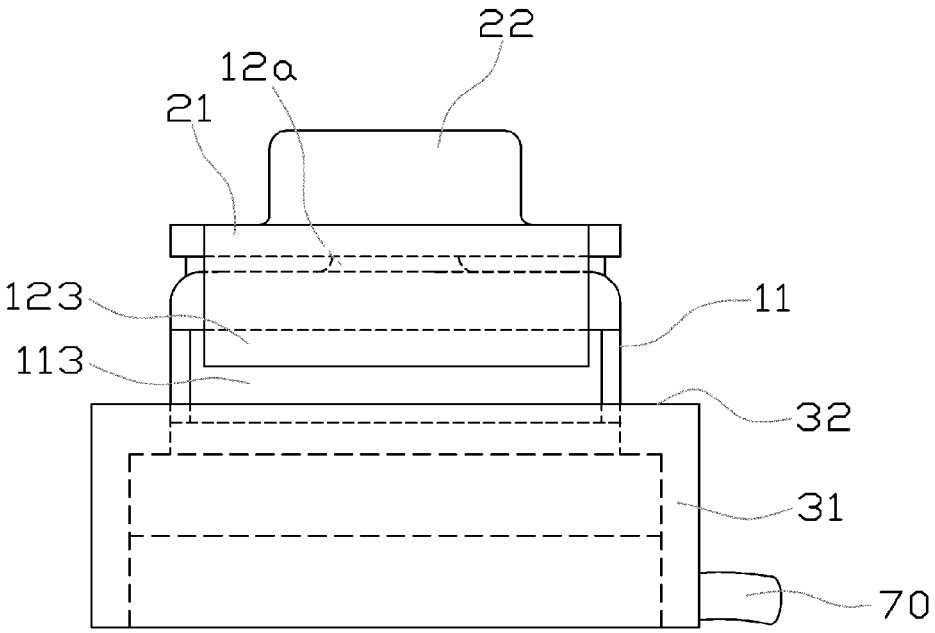
FIG. 9 is a front view of the push switch according to the second exemplary mode of embodiment of the present invention.
Figure 10:
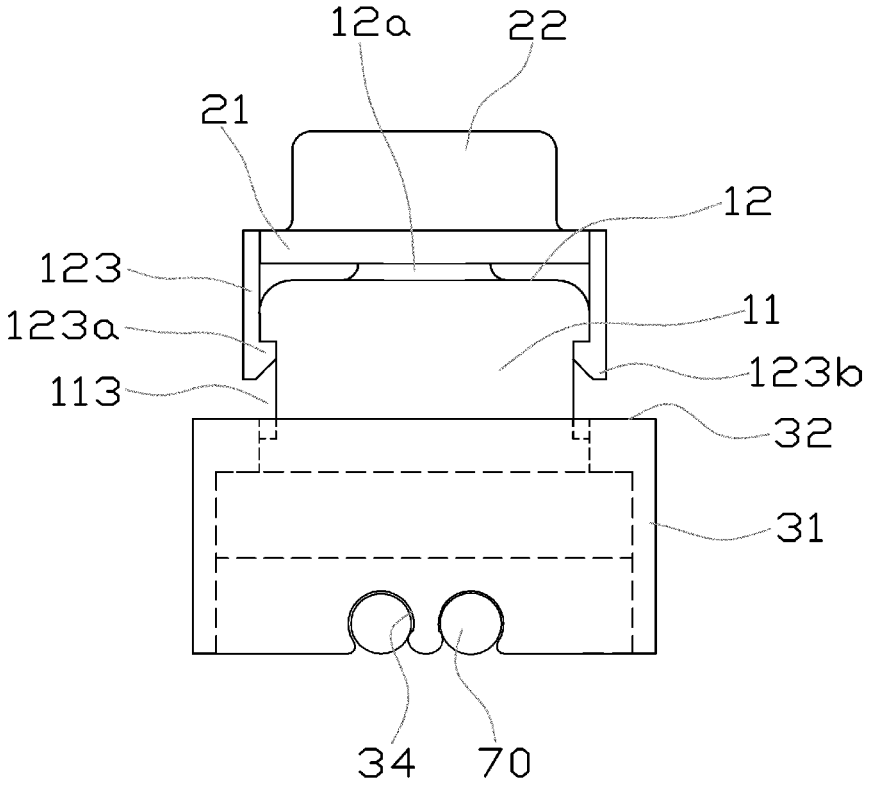
FIG. 10 is a right side-view of the push switch according to the second exemplary mode of embodiment of the present invention.

In FIG. 8 to FIG. 10, constituent parts that are the same as in the first exemplary mode of embodiment are given the same reference numerals, and redundant description thereof is forgone.

In this example, the major differences with respect to the first exemplary mode of embodiment reside in the following two points.

First, in the first exemplary mode of embodiment, guide grooves 13 were formed on the four peripheral faces of the peripheral sidewall 11, which extended in the vertical direction, but in the push switch 1B of this example, guide grooves 113 are formed in two facing faces of the peripheral sidewall 11, and extend in the horizontal direction.

Furthermore, in the first exemplary mode of embodiment, the legs 23, which were somewhat elastic, extended from the four sides of the top wall 21, but in the push switch 1B of this example, legs 123, which do not particularly have to be elastic, extend downward from two facing faces of the top wall 21.

The push switch 1B of this example is configured so that claw-shaped engaged parts 123*a*, which are provided at the bottom ends of the legs 123 fit into the guide grooves 113, and the cap 20 is mounted on top of the button 10 by sliding it sideways.

The structure is such that, when the cap 20 is mounted on top of the button 10, a portion of the roof wall 12 (top face of the operation projection 12*a*) makes contact with the bottom face of the top wall 21, and the engaged parts 123*a* are engaged at the top ends of the guide grooves 13.

With the push switch 1B of this example, the cap 20 can be removed from the button 10 relatively easily by sliding the cap 20 sideways. Consequently, it is possible to flexibly support a variety of color specifications and the like.

Furthermore, in the push switch 1B of this example as well, the distance between the bottom ends of the protrusions 123*b* that protrude from the outer surface of the peripheral sidewall 11 and the top face of the inner flange 32 is established so as to be substantially the same as the stroke distance up to the point at which the switch 40 is turned on by pushing the push-operation member 22, and the press stroke of the push-operation member 22 is regulated by the legs 123 making direct contact with the case 30.

Furthermore, in the push switch 1B of this example as well, the guide grooves 113 extend below the top face of the inner flange 32, such that the soft button 10 will not be trapped between the hard cap 20 and the hard case 30 when the press stroke of the push-operation member 22 is regulated.

Two embodiments of the present invention were described above, but the present invention is not limited to these embodiments, and needless to say, suitable changes and the like are possible within a scope that does not depart from the gist of the present invention.

Figure 11:
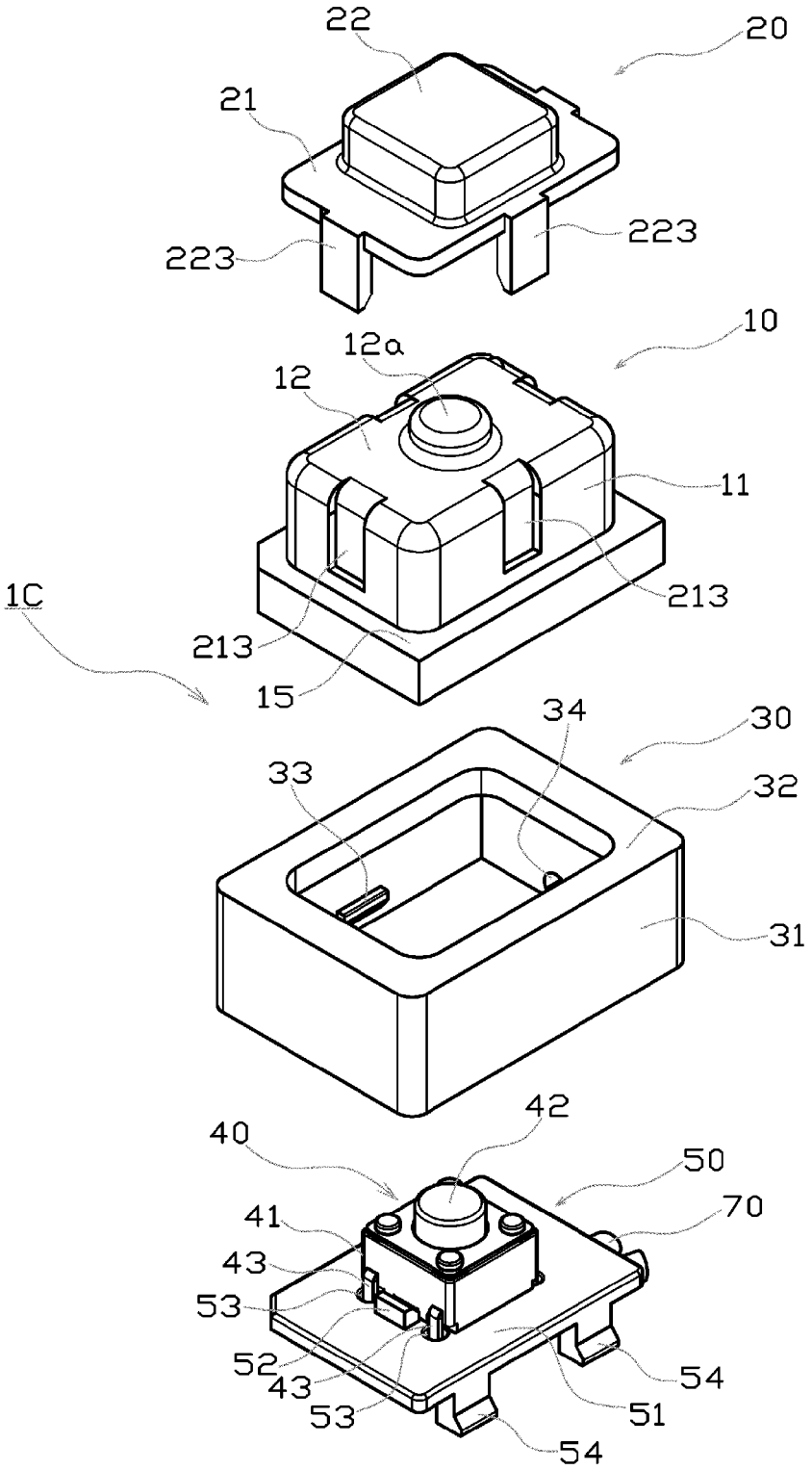
FIG. 11 is an exploded perspective view of a push switch according to a third exemplary mode of embodiment of the present invention.
Figure 12:
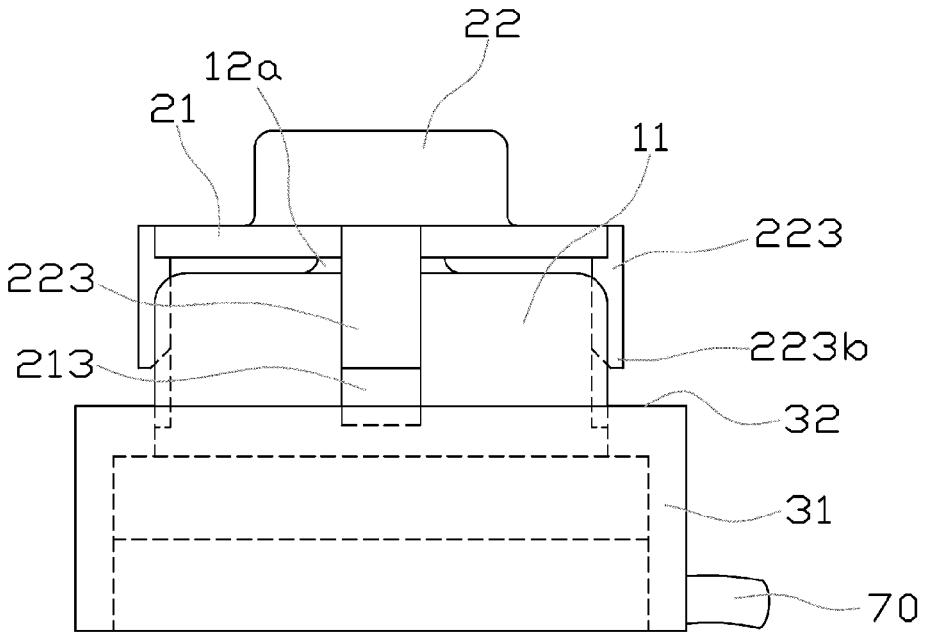
FIG. 12 is a front view of the push switch according to the third exemplary mode of embodiment of the present invention.
Figure 13:
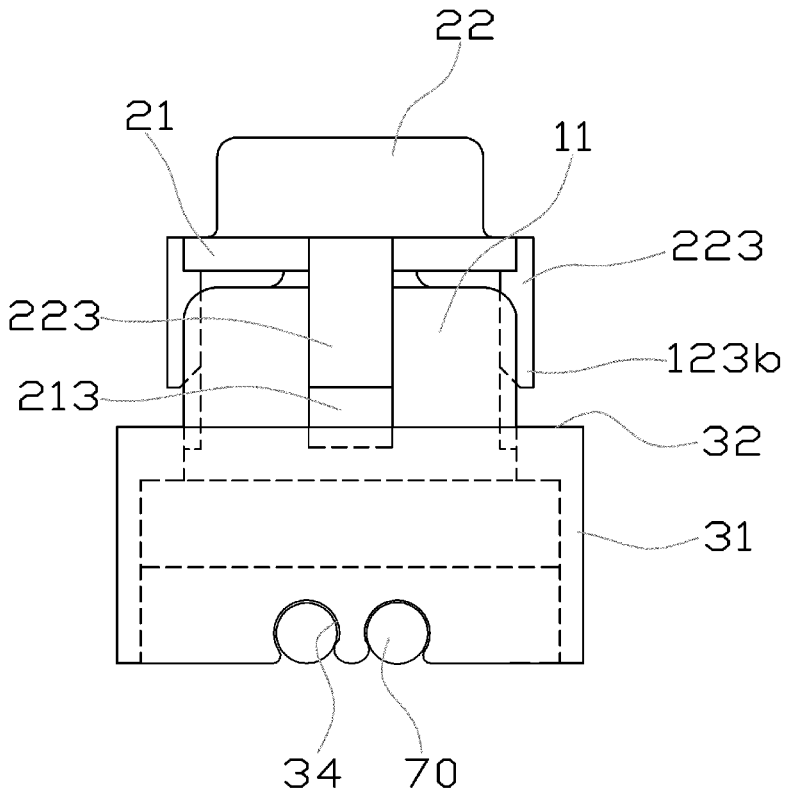
FIG. 13 is a right side-view of the push switch according to the third exemplary mode of embodiment of the present invention.

In the exemplary modes of embodiment described above, a connection structure was adopted in which the button and the cap engaged with each other, but the structure may also be one in which, for example as shown in FIG. 11 to FIG. 13, straight legs 223 simply fit into straight guide grooves 213. In this case, if the strength of the fit is excessive, the friction between the button 10 and the cap 20 when the cap is push-operated will be great, such that operability will be inferior, and therefore it is desirable that a suitable degree of fitting strength to be established. However, if the fitting strength is insufficient, the impact when the pushing on the push-operation member 22 is released and the roof wall 12 returns to the undeformed state may loosen the fitting, and the top wall 21 may strike the surface member of the vehicle door handle device strongly, producing an abnormal sound. In such cases, the occurrence of abnormal sounds can be prevented by fitting an elastic O-ring or the like on the top face of the top wall 21, around the push-operation member 22.

Furthermore, in the exemplary modes of embodiment described above, an operation projection 12*a* was provided on the top face of the button 10, but it is not absolutely necessary to provide an operation projection 12*a*, so long as the configuration allows the button 10 to press the operation part 42 downward and turn the switch 40 on, as a result of a push-operation on the push-operation member 22.

What is claimed is:

1. A push switch comprising:

a soft button having a peripheral sidewall and a roof wall, and having an opening at a bottom of the button;

a hard cap, which is mounted on top of the button;

a base, which is mounted in the opening;

a switch component, which is arranged on the base and in the button; and a case fastened to an outer peripheral face of the peripheral sidewall;

wherein the button has a plurality of guide grooves, extending in a vertical direction or a horizontal direction, in the outer peripheral face of the peripheral sidewall;

wherein the cap has a top wall, which makes contact with the roof wall, a push-operation member, which protrudes upward from the top wall, and a plurality of legs that extend downward from the top wall, the legs being fitted into the guide grooves, so as to be separably connected to the button;

wherein a press stroke of the push-operation member is regulated by the legs coming into contact with the case when the push-operation member is pushed; and wherein the case has an inner flange, and the legs make contact with a top face of the inner flange, when the push-operation member is pushed.

2. The push switch according to claim 1, wherein the guide grooves extend below the top face of the inner flange.

3. A push switch comprising:

a soft button having a peripheral sidewall and a roof wall, and having an opening at a bottom of the button;

a hard cap, which is mounted on top of the button;

a base, which is mounted in the opening;

a switch component, which is arranged on the base and in the button; and a case fastened to an outer peripheral face of the peripheral sidewall;

wherein the button has a plurality of guide grooves, extending in a vertical direction or a horizontal direction, in the outer peripheral face of the peripheral sidewall;

wherein the cap has a top wall, which makes contact with the roof wall, a push-operation member, which protrudes upward from the top wall, and a plurality of legs that extend downward from the top wall, the legs being fitted into the guide grooves, so as to be separably connected to the button;

wherein a press stroke of the push-operation member is regulated by the legs coming into contact with the case when the push-operation member is pushed; and wherein the guide grooves extend below a contact face of the case, with which the legs make contact when the push-operation member is pushed.

4. A push switch comprising:

a soft button having a peripheral sidewall and a roof wall, and having an opening at a bottom of the button;

a hard cap, which is mounted on top of the button;

a base, which is mounted in the opening;

a switch component, which is arranged on the base and in the button; and a case fastened to an outer peripheral face of the peripheral sidewall;

wherein the button has a plurality of guide grooves, extending in a vertical direction or a horizontal direction, in the outer peripheral face of the peripheral sidewall;

wherein the cap has a top wall, which makes contact with the roof wall, a push-operation member, which protrudes upward from the top wall, and a plurality of legs that extend downward from the top wall, the legs being fitted into the guide grooves, so as to be separably connected to the button;

wherein a press stroke of the push-operation member is regulated by the legs coming into contact with the case when the push-operation member is pushed;

wherein the legs have protrusions that protrude to an exterior of the guide grooves; and wherein the protrusions make contact with the case when the push-operation member is pushed.

5. The push switch according to claim 4, wherein the case has an inner flange, the protrusions making contact with a top face of the inner flange, when the push-operation member is pushed.

6. The push switch according to claim 5, wherein the guide grooves extend below the top face of the inner flange.

* * * * *